United States Patent [19]

Weatherell et al.

[11] 4,034,517

[45] July 12, 1977

[54] WORKPIECE FINISHING MACHINE

[75] Inventors: James W. Weatherell; Francis R. Chesner, both of Olean, N.Y.

[73] Assignee: Clair Mfg. Co., Inc., Olean, N.Y.

[21] Appl. No.: 655,267

[22] Filed: Feb. 4, 1976

[51] Int. Cl.[2] ..... B24B 41/06

[52] U.S. Cl. ..... 51/92 R; 269/21; 51/45; 51/171; 51/235

[58] Field of Search ..... 51/235, 171, 45; 269/21

[56] References Cited

U.S. PATENT DOCUMENTS

| | | | |
|---|---|---|---|
| 2,414,574 | 1/1947 | Williams | 269/21 |
| 3,589,072 | 6/1971 | Burt | 51/45 |
| 3,711,082 | 1/1973 | Seidenfaden | 269/21 |
| 3,724,835 | 4/1973 | Gnoth | 269/21 |

*Primary Examiner*—Harold D. Whitehead
*Assistant Examiner*—Roscoe V. Parker
*Attorney, Agent, or Firm*—Bean, Kauffman & Bean

[57] ABSTRACT

This invention relates to surface finishing machines and more particularly to a bench size machine featuring a multiple workpiece positioning holder adapted to be removably supported on a vacuum, hold down assembly, which is in turn mounted for multiple directional reciprocating movements within the machine for passing the workpieces for finishing engagement with a finishing roll.

9 Claims, 5 Drawing Figures

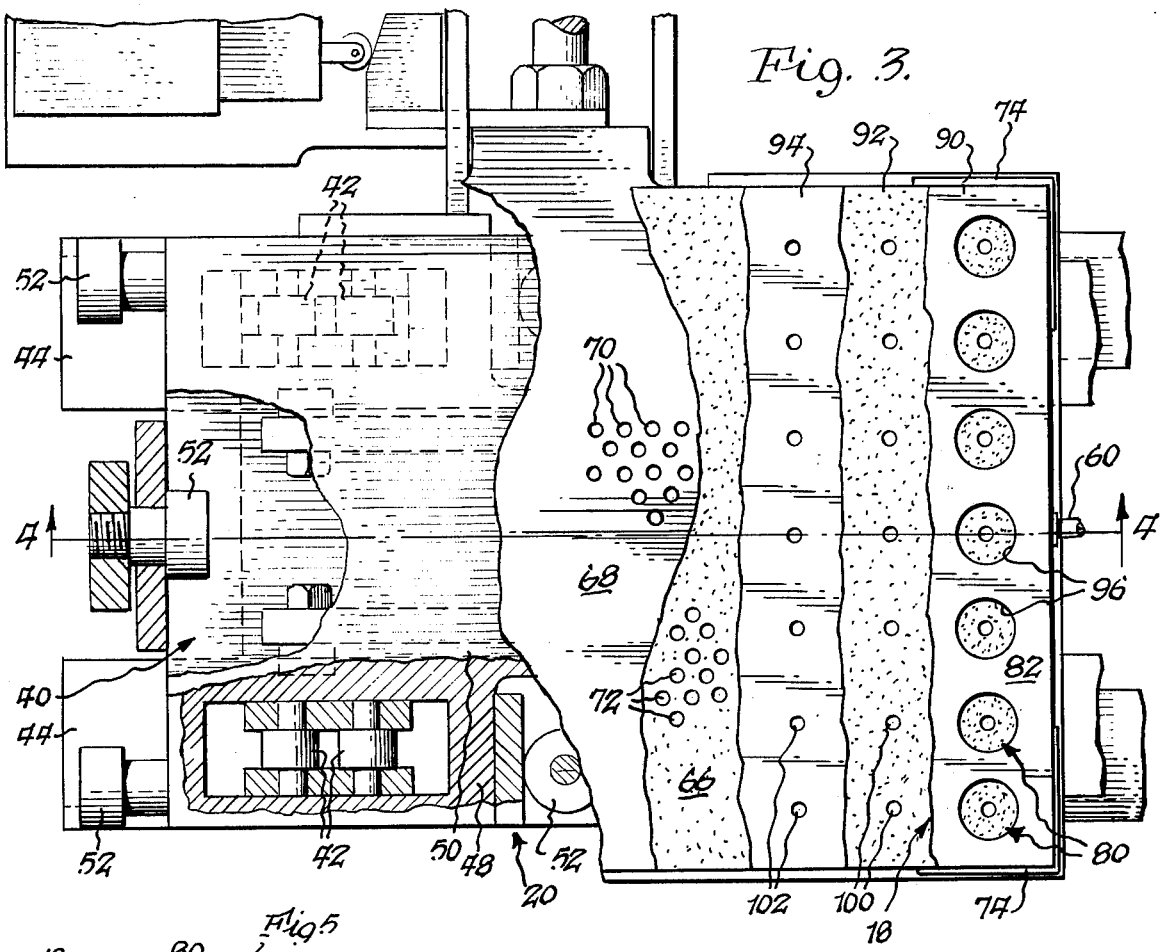
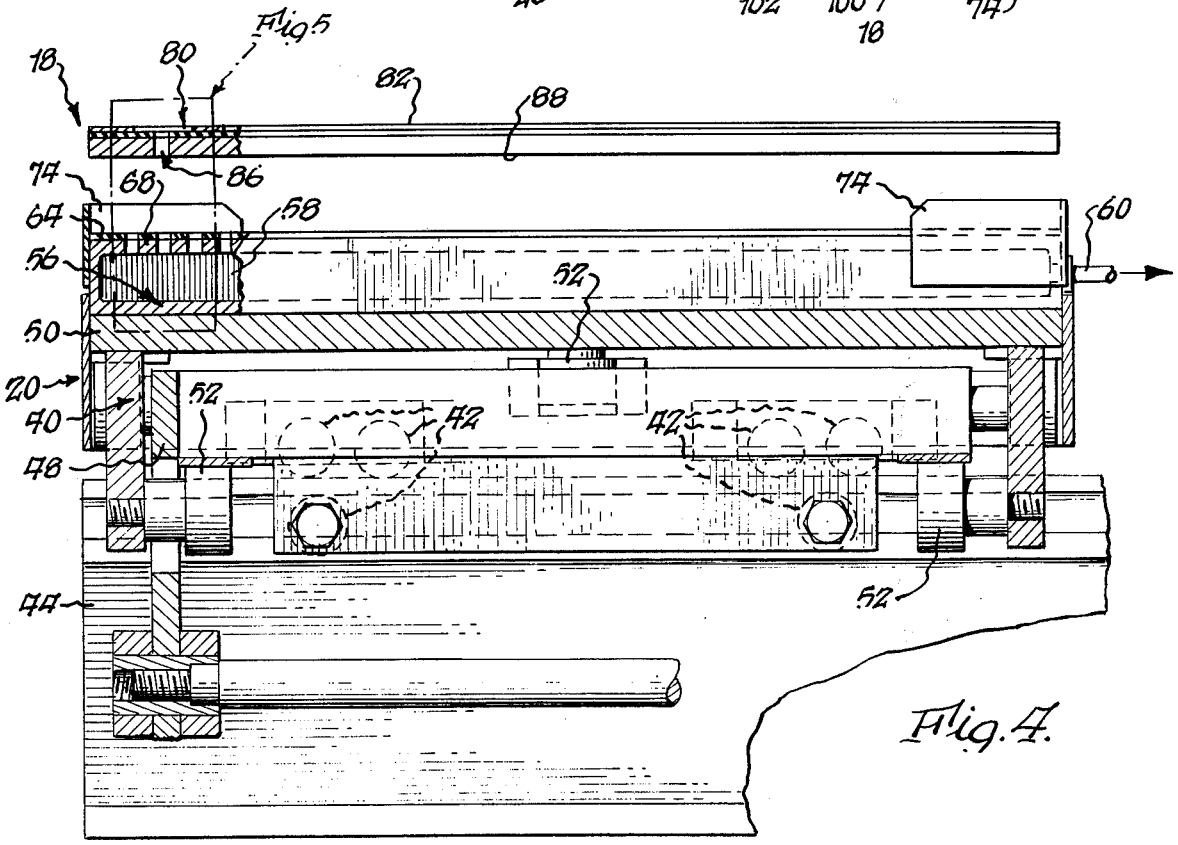
Fig. 4.

WORKPIECE FINISHING MACHINE

SUMMARY OF THE INVENTION

The present invention is directed towards an improvement in a workpiece finishing machine of the general type disclosed in commonly assigned U.S. Pat. No. 3,589,072, which facilitates surface finishing of a plurality of workpieces, during each operational cycle of the machine.

More particularly, the present invention is directed towards a multiple workpiece holder, which is adapted to be removably supported on a vacuum, hold down assembly of the machine; the latter being operative to simultaneously lock the workpieces relative to the holder and the holder relative to the hold down assembly.

In a preferred form of the invention, the workpiece holder is of a laminate or composite construction including permanently interconnected upper, intermediate and lower sheets. The upper sheet is intended to positionally locate the workpieces and to this end is formed with a plurality of through openings serving to peripherally bound the workpiece receiving recesses. The upper sheet would preferably be of a relatively rigid and abrasive resistant construction and have a thickness sufficient to provide lateral support for the workpieces, while at the same time allowing their upper surfaces to be disposed above the upper surface of the workpiece holder for surface finishing engagement with a finishing roll of the machine. The intermediate sheet is formed of resiliently deformable material and serves to define a bottom workpiece supporting surface for each of the recesses. The lower sheet is intended to impart rigidity and strength to the workpiece holder and to cooperate with the intermediate sheet to define a plurality of passageways which communicate one with each of the recesses and open downwardly through a lower surface of the workpiece holder.

Further, in accordance with the preferred form of the present invention, the vacuum, hold down assembly of the machine is provided with a support or cover sheet formed of resiliently deformable material, which serves to define a support surface engageable by the lower surface of the workpiece holder and is formed with a plurality of apertures arranged for communication with a source of vacuum. The assembly additionally includes means to positionally locate the workpiece holder relative to the support surface in order to arrange its passageways in flow communication with at least certain ones of the apertures defined by the support sheet. Thus, when the apertures are placed in communication with a vacuum, air is exhausted from the apertures and passageways with the result that the workpieces are automatically drawn into sealing engagement with the bottom surface of each of the workpiece holder recesses, as the workpiece holder is drawn into sealing engagement with the support sheet. On the other hand, when the vacuum condition is interrupted, as an incident to the completion of a finishing operation, the workpiece and the workpiece holder are simultaneously released, thereby to permit removal of the holder from the hold down assembly and subsequent dumping of the workpieces from the holder.

It is contemplated that two or more workpiece holders would be provided with each machine in order to permit an operator to load a batch of workpieces into one holder, while another batch of workpieces previously loaded in another holder is being finished.

DRAWINGS

The nature and mode of operation of the present invention will now be more fully described in the following detailed description taken with the accompanying drawings wherein:

FIG. 3 is an enlarged top plan view of a portion of the machine with parts broken away for clarity;

FIG. 4 is a sectional view taken generally along the line 4—4 in FIG. 3; and

DETAILED DESCRIPTION

Figures 1, 5:
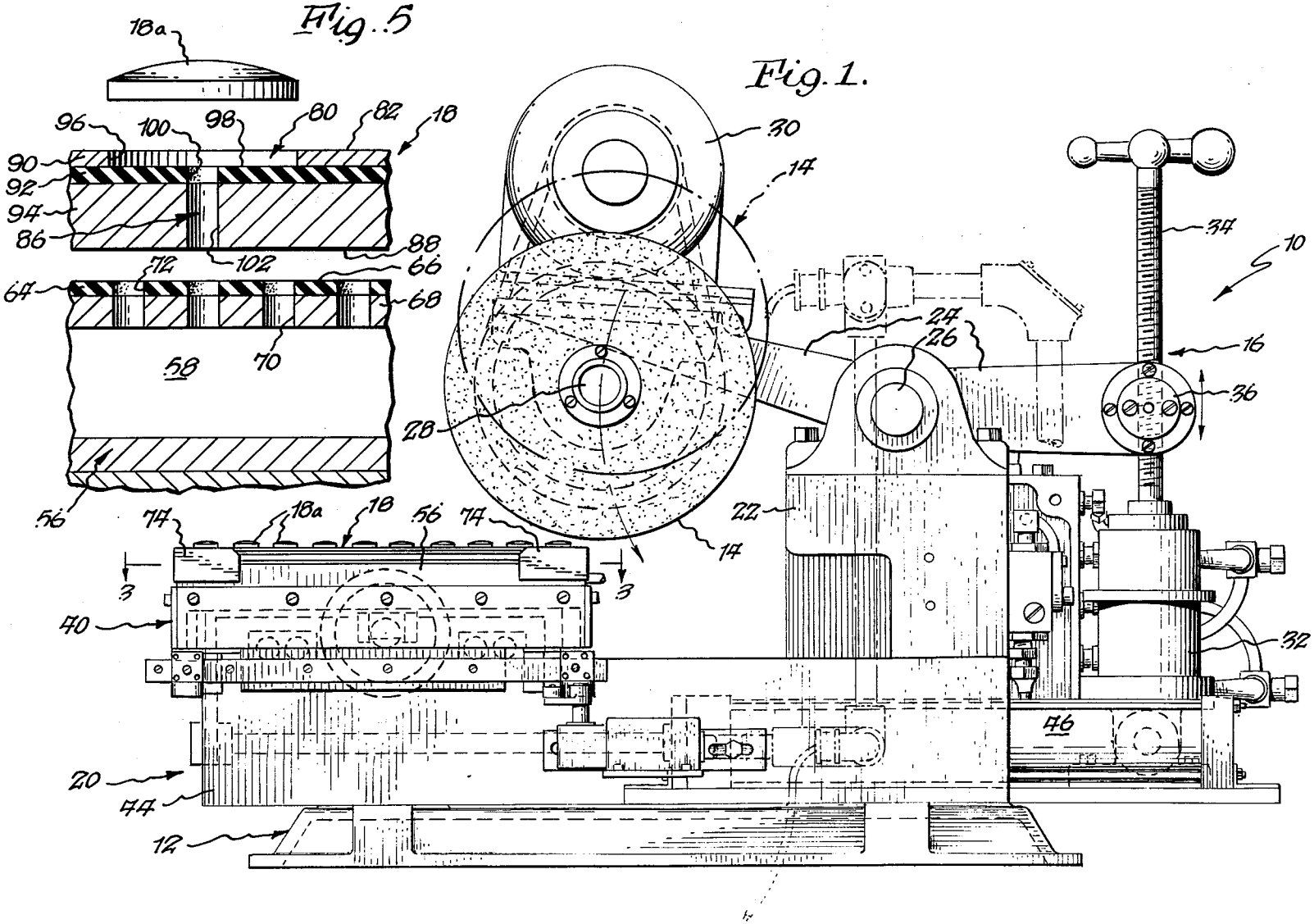
FIG. 1 is a side elevational view of a finishing machine incorporating the present invention.
FIG. 5 is an enlarged view of the area designated as FIG. 5 in FIG. 4.
Figure 2:
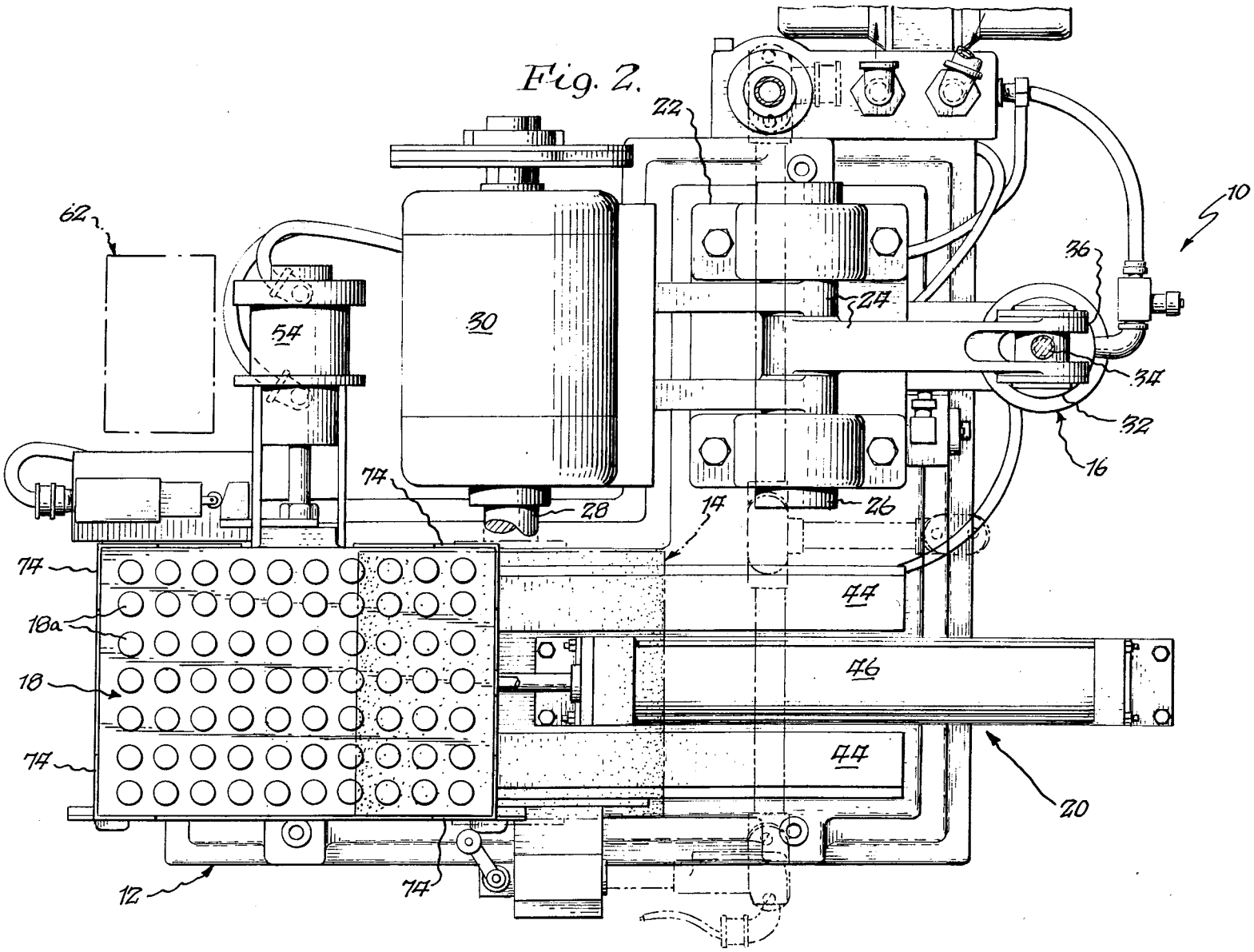
FIG. 2 is a top plan view thereof.

Reference is now made particularly to FIGS. 1 and 2, wherein a machine incorporating the present invention is designated as 10 and shown as generally including a machine base 12; a workpiece or article finishing roll 14; a roll supporting and drive assembly 16, which is mounted upon base 12 for supporting finishing roll 14 for vertical movements between an upper or rest position and a lower or finishing position shown in phantom and full line in FIG. 1, respectively; a workpiece or article holder or fixture 18 adapted to removably support a plurality of workpiece 18*a;* and a workpiece holder supporting and drive assembly 20, which is adapted to removably support workpiece holder 18 on base 12 for horizontally directed movements relative to finishing roll 14.

Assembly 16 is shown in FIGS. 1 and 2 as including a standard 22; a mounting arm 24, which is supported intermediate its opposite ends for vertically directed pivotal movements about a horizontally disposed pivot axis by means of a pivot shaft 26 carried by the upper end of standard 22; a finishing roll mounting drive shaft 28, which is carried adjacent one end of arm 24 and drivingly coupled to a suitable source of power, such as electric motor 30; and a pneumatically operated control cylinder 32, which is pivotally fixed to base 12 and has a piston rod 34 adjustably fixed to a pivot bearing device 36 carried by an opposite end of arm 24. As will be apparent, the selectively controlled introduction of air under pressure to opposite ends of control cylinder 32 serves to effect vertical movements of finishing roll 14 between its upper and lower positions and to control the working or finishing pressure of the finishing roll, while in its lower position. Assembly 16 may be similar in construction and mode of operation to that described in U.S. Pat. No. 3,589,072, whose disclosure is incorporated herein by reference. Also, it will be understood that the construction and composition of finishing roll 14 will vary depending upon the finish to be imparted to workpieces 18*a*.

Assembly 20 is shown in FIGS. 1 through 4, as including a work table assembly 40, which is mounted by means of a plurality of roller-guide devices 42 on a pair of parallel, base affixed slideways 44 for horizontal reciprocating movements relatively beneath and in a direction normal to the rotational axis of finishing roll 14 under the control of a hydraulically relatively long stroke operated, cylinder device 46.

Work table assembly 40 includes a lower table portion 48, which serves to carry roller-guide devices 42;

and an upper table portion or vacuum hold down assembly 50, which is mounted by means of a plurality of roller-guide devices 52 on lower table portion 48 for horizontally reciprocating movements relative thereto in a direction disposed parallel to the rotational axis of finishing roll 14 under the control of pneumatically operated, relatively short stroke cylinder device 54.

In accordance with a preferred form of the present invention, upper table portion 50 includes a metal casting 56, which serves to define a vacuum chamber 58 selectively connected as by a conduit 60 to a suitable source of vacuum, not shown, under the control of a suitable machine operator control console 62, shown in phantom line only in FIG. 2; and a support or cover sheet 64 formed of resiliently deformable material, which is supported on casting 56 and serves to define a support surface 66 for workpiece holder 18. The upper wall 68 of casting 56, which bounds chamber 58, and sheet 64 are best shown in FIGS. 4 and 5, as being formed with a plurality of apertures 70 and 72, respectively, which are preferably of like diameter and relatively uniformly distributed in columns and rows throughout the extent of support surface 66. Associated ones of apertures 70 and 72 may be maintained in alignment by any suitable means, such as by positionally locating sheet 64 relative to casting 56 by casting mounted corner locator brackets 74 or, if desired, by permanently affixing sheet 64 to casting 56 by any suitable adhesive or clamping device. Alternatively, apertures 70 and/or apertures 72 of each column or row of apertures may be merged or joined to define a plurality of parallel apertures in the form of slot openings. Further, it is contemplated that the center of sheet 64 may be cut away to define a border sealing strip bounding a single, large aperture, not shown.

Workpiece holder 18 is shown in the drawings as being in the form of a flat plate, which is generally rectangular when viewed in plan. Workpiece holder 18 is formed with a plurality of recesses 80, which open through its upper surface 82 and are sized and shaped to positionally receive workpieces 18a, such as buttons whose upper surfaces are to be finished; and a plurality of passageways 86, which are arranged in flow communication one with each of recesses 80 and open through its lower surface 88. The diameter of each of passageways 86 would preferably conform to the diameter of each of apertures 72.

Preferably, workpiece holder 18 is of a laminate or composite construction including permanently interconnected upper, intermediate and lower sheets 90, 92 and 94, respectively. Upper sheet 90 is intended to positionally locate workpieces **18*a* and to this end is formed with through openings 96 serving to peripherally bound recesses 80. Upper sheet 90 would preferably be of a relatively rigid and abrasive resistant construction and have a thickness sufficient to provide lateral support for workpieces 18*a*, while at the same time allowing the upper surfaces of these workpieces to be disposed above surface 82 for surface finishing engagement with finishing roll 14. Intermediate sheet 92 is intended to provide a lower or workpiece supporting-sealing surface 98 for each of recesses 80, and to this end is formed from a material capable of undergoing resilient deformation sufficient to air sealingly conform to the contour of the lower surface of workpieces 18*a*. Intermediate sheet 92 is formed with a plurality of through openings 100, which would normally be located centrally of each of surfaces 98. Lower sheet 94, which is primarily intended to impart rigidity and strength to workpiece holder 18, is formed with a plurality of through openings 102 arranged one in association with each of openings 98 to define passageways 86. At least lower sheet 94, and preferably the whole of workpiece holder 18, is sized to extend essentially coextensively with support surface 66**.

For any given machine 10, the number of recesses 80 and passageways 86, as well as the thickness of upper sheet 90, will depend upon the shape and size of the workpieces to be processed. In any event, the positioning of passageways 86 within holder 18 will be such that they are caused to be automatically aligned with at least certain ones of apertures 72, whenever the holder is removably-positionally located by locator brackets 74 in surface-to-surface engagement with support sheet 64. As a practical matter, apertures 72 would normally be arranged in a closely spaced relationship and be of a number in excess of the number of passageways provided in any given workpiece holder, in order to provide machine 10 with the capability of handling a single workpiece in the form of flat sheet material, not shown, when the workpiece holder is not supported on work table assembly 40.

In operation of machine 10, an operator would normally first load workpieces **18*a* into recesses 80 of workpiece holder 18, while it is located at a convenient work station normally arranged conveniently adjacent machine 10. Workpiece holder 18 would then be accurately placed on work table assembly 40 with the aid of locator brackets 74, while roll 14 is disposed in its upper position shown in phantom line in FIG. 1 and the work table assembly is disposed in its forward rest or locating position shown in full line in FIG. 1. The operator would then operate a suitable switch provided on console 62 to place chamber 58 in communication with a source of vacuum; the existence of a vacuum condition within chamber 58 serving to remove air from apertures 70 and 72 and passageways 86, and thereby lock or retain workpieces 18*a* within recesses 80 in firm seating-air sealing engagement with recess surfaces 98 and to lock workpiece holder 18 relative to work table assembly 40 in firm seating-air sealing engagement with support surface 66. As desired, operation of machine 10 may proceed automatically, or be selectively initiated by operator actuation of another suitable switch provided on console 62. In any event, machine 10 would preferably include an electricalpneumatic-hydraulic-control circuit arrangement similar to that described in U.S. Pat. No. 3,589,072, which serves to control operation of cylinder devices 32, 46 and 54, such that finishing roll 14 is lowered for finishing engagement with workpieces 18*a*, as cylinder devices 46 and 54 cause desired movements of the workpieces relative to the finishing roll. When the finishing operation is completed, the control circuit arrangement would be automatically operative to return the finishing roll and the work table assembly to their rest positions and to interrupt the vacuum condition existing in chamber 58 in order to unlock or release workpiece holder 18** for operator removal from the machine.

It is contemplated that two or more workpiece holders would be provided with each machine in order to permit an operator to load a batch of workpieces into one holder, while another batch of workpieces previously loaded in another holder is being finished.

We claim:

1. In a workpiece finishing machine, the combination comprising:

a powered finishing roll;

a workpiece holder having a plurality of workpiece receiving recesses opening through an upper surface thereof and a plurality of passageways arranged in flow communication with said recesses and opening through a lower surface thereof;

a work table assembly having a support surface for supportingly engaging said lower surface of said workpiece holder and means for selectively placing said passageways in flow communication with a source of vacuum, whereby to releasably retain said workpiece holder in engagement with said support surface and said workpieces seated within said recesses, said work table assembly being covered with a sheet of resiliently deformable material serving to define said support surface and including means to positionally locate said lower surface of said workpiece holder relative to said support surface, said sheet being apertured to afford flow communication with said source, and said passageways being arranged to open through said lower surface for alignment with at least certain of said apertures when said lower surface is engaged with said support surface; and means for effecting relative movements of said support surface and said finishing roll for passing said workpieces in surface finishing engagement with said finishing roll.

2. A machine according to claim 1, wherein apertures are relatively uniformly distributed in columns and rows throughout the extent of said support surface.

3. In a workpiece finishing machine, the combination comprising:

a powered finishing roll;

a workpiece holder having a plurality of workpiece receiving recesses opening through an upper surface thereof and a plurality of passageways arranged in flow communication with said recesses and opening through a lower surface thereof; each of said recesses being bounded in part by a bottom, workpiece supporting surface formed from resiliently deformable material;

a work table assembly having a support surface for supportingly engaging said lower surface of said workpiece holder and means for selectively placing said passageways in flow communication with a source of vacuum, whereby to releasably retain said workpiece holder in engagement with said support surface and said workpieces seated within said recesses; and means for effecting relative movements of said support surface and said finishing roll for passing said workpieces in surface finishing engagement with said finishing roll.

4. In a workpiece finishing machine, the combination comprising:

a powered finishing roll;

a workpiece holder having a plurality of workpiece receiving recesses opening through an upper surface thereof and a plurality of passageways arranged in flow communication with said recesses and opening through a lower surface thereof, said workpiece holder being of a laminated construction comprising a rigid top sheet, an intermediate sheet formed of resiliently deformable material and a rigid bottom sheet, said top sheet having vertically extending through openings for peripherally bounding said recesses, said intermediate sheet defining a bottom workpiece supporting surface of each of said recesses, and said intermediate and bottom sheets having aligned openings cooperating to define said passageways;

a work table assembly having a support surface for supportingly engaging said lower surface of said workpiece holder and means for selectively placing said passageways in flow communication with a source of vacuum, whereby to releasably retain said workpiece holder in engagement with said support surface and said workpieces seated within said recesses; and means for effecting relative movements of said support surface and said finishing roll for passing said workpieces in surface finishing engagement with said finishing roll.

5. A machine according to claim 4, wherein said work table assembly is covered with a sheet of resiliently deformable material serving to define said support surface and includes means to positionally locate said lower surface of said workpiece holder relative to said support surface, said sheet being apertured to afford flow communication with said source, and said passageways being arranged to open through said lower surface for alignment with at least certain of said apertures when said lower surface is engaged with said support surface.

6. A machine according to claim 5, wherein cross-sectional areas of flow communicated, associated ones of said passageways and said apertures are essentially equal.

7. A machine according to claim 6, wherein apertures are relatively uniformly distributed in columns and rows throughout the extent of said support surface.

8. A workpiece holder adapted for use in a workpiece finishing machine of the type including a powered finishing roll, means defining a support surface on which said workpiece holder may be removably disposed and at least one aperture opening through said support surface for selective communication with the source of vacuum, and means for effecting relative movements of said support surface and said finishing roll for passing workpieces supported by said workpiece holder in surface finishing engagement with said finishing roll, said workpiece holder being in the form of a generally flat plate having recesses opening through an upper surface thereof and passageways arranged in flow communication with said recesses and opening through a lower surface thereof, said recesses being sized and shaped to peripherally bound individual ones of said workpieces and to bottom support same therewithin, whereby to position surfaces of said workpieces to be finished above said upper surface, each of said recesses being bounded in part by a bottom, workpiece supporting surface formed from resiliently deformable material, said lower surface being sized to extend essentially coextensive with said support surface and said passageways being arranged to open one through each said workpiece supporting surface and through said lower surface for flow communication with said aperture when said workpiece holder is engaged with said support surface.

9. A workpiece holder adapted for use in a workpiece finishing machine of the type including a powered finishing roll, means defining a support surface on which said workpiece holder may be removably disposed and at least one aperture opening through said support surface for selective communication with the source of vacuum, and means for effecting relative movements of said support surface and said finishing roll for passing workpieces supported by said workpiece holder in surface finishing engagement with said finishing roll, said workpiece holder being in the form of a generally flat plate having recesses opening through an upper surface thereof and passageways arranged in flow communication with said recesses and opening through a lower surface thereof, said recesses being sized and shaped to peripherally bound individual ones of said workpieces and to bottom support same therewithin, whereby to position surfaces of said workpieces to be finished above said upper surface, said lower surface being sized to extend essentially coextensive with said support surface and said passageways being arranged to open through said lower surface for flow communication with said aperture when said workpiece holder is engaged with said support surface, said plate being of a laminated construction comprising a rigid top sheet, an intermediate sheet formed of resiliently deformable material and a rigid bottom sheet, said top sheet having vertically extending through openings for peripherally bounding said recesses, said intermediate sheet defining a bottom workpiece supporting surface of each of said recesses, and said intermediate and bottom sheets having aligned openings cooperating to define said passageways.

* * * * *